US009115880B2

(12) United States Patent
Engel-Hall et al.

(10) Patent No.: US 9,115,880 B2
(45) Date of Patent: Aug. 25, 2015

(54) LIGHTING SYSTEM RECONFIGURABLE BY GESTURAL CONTROL

(71) Applicant: ABL IP Holding, LLC, Conyers, GA (US)

(72) Inventors: Aaron Mathew Engel-Hall, San Francisco, CA (US); Peter Y. Y. Ngai, Alamo, CA (US); Michael Trung Tran, Oakland, CA (US); Darren Blum, San Mateo, CA (US)

(73) Assignee: ABL IP Holding, LLC, Conyers, GA (US)

( * ) Notice: Subject to any disclaimer, the term of this patent is extended or adjusted under 35 U.S.C. 154(b) by 0 days.

(21) Appl. No.: 13/888,314

(22) Filed: May 6, 2013

(65) Prior Publication Data

US 2013/0294067 A1 Nov. 7, 2013

Related U.S. Application Data

(60) Provisional application No. 61/643,203, filed on May 4, 2012.

(51) Int. Cl.

| | |
|---|---|
| ***F21V 21/15*** | (2006.01) |
| ***F21S 8/06*** | (2006.01) |
| ***F21V 21/16*** | (2006.01) |
| *F21V 23/04* | (2006.01) |
| *F21Y 105/00* | (2006.01) |

(52) U.S. Cl.

CPC ..... *F21V 21/15* (2013.01); *F21S 8/061* (2013.01); *F21V 21/16* (2013.01); *F21V 23/0471* (2013.01); *F21Y 2105/008* (2013.01)

(58) Field of Classification Search

CPC ..... F21V 21/15; F21V 21/16; F21V 23/0471; F21S 8/061; F21Y 2105/008

USPC ..... 362/233, 372, 147, 545, 285–289, 418, 362/419, 430, 403, 404, 276

See application file for complete search history.

(56) References Cited

U.S. PATENT DOCUMENTS

| | | | | |
|---|---|---|---|---|
| 6,299,337 | B1 * | 10/2001 | Bachl et al. | 362/545 |
| 6,488,387 | B2 * | 12/2002 | Wardenburg | 362/220 |
| 7,241,038 | B2 * | 7/2007 | Naniwa et al. | 362/525 |
| 8,449,156 | B2 * | 5/2013 | Salter et al. | 362/464 |
| 8,467,568 | B2 | 6/2013 | Roberts et al. | |
| 2002/0149927 | A1 * | 10/2002 | Westhofen | 362/147 |
| 2004/0207997 | A1 * | 10/2004 | Stewart et al. | 362/31 |
| 2005/0243549 | A1 * | 11/2005 | Ruston | 362/233 |
| 2010/0312366 | A1 | 12/2010 | Madonna et al. | |
| 2012/0293404 | A1 | 11/2012 | Federico et al. | |

FOREIGN PATENT DOCUMENTS

| | | | |
|---|---|---|---|
| WO | 2013085600 | A2 | 6/2013 |

* cited by examiner

*Primary Examiner* — Bao Q Truong

(74) *Attorney, Agent, or Firm* — Beeson Skinner Beverly, LLP

(57) ABSTRACT

A luminaire, such as a ceiling suspended luminaire, that can change its shape or some other state or characteristic based on user-input. The changes of shape or other state or characteristic can be achieved by hand gestures, such as moving the hand up and down in the detection field of a sensor. In one aspect of the invention, a suspended luminaire having a flexible sheet form is provided. The shape or attitude of the sheet form luminaire can be changed by exerting a force on one or more attachment points on the luminaire.

24 Claims, 10 Drawing Sheets

LIGHTING SYSTEM RECONFIGURABLE BY GESTURAL CONTROL

CROSS-REFERENCE TO RELATED APPLICATION

This application claims the benefit of U.S. Provisional Patent Application No. 61/643,203 filed May 4, 2012, which is incorporated herein by reference.

FIELD OF INVENTION

The present invention generally relates to the field of lighting, and more particularly to luminaires used for illuminating spaces such as architectural spaces. The invention has particular application for improvements in ceiling suspended luminaires where the luminaire is a prominent architectural element within the space.

SUMMARY OF INVENTION

The invention is directed to an in-place luminaire, such as a ceiling suspended luminaire, that can change its shape or some other state or characteristic based on user-input. The changes, such as changes of shape and thus the physical appearance of the luminaire within the space, can be achieved by hand gestures, such as moving the hand upwards and downwards in the path of a sensor. The sensor can be a distance or motion sensor, for example, a sensor located in an overhead ceiling near the luminaire or a sensor on the luminaire itself. The sensor is associated with a detection system that senses purposeful user gestures and ignores other human activity in the vicinity of the luminaire. Purposeful gestures can be pre-defined hand gestures, for example, moving the hand up or down within a relatively narrow detection field of a motion sensor near the luminaire.

In one aspect of the invention, a suspended luminaire having a flexible sheet form is provided. The shape or attitude of the sheet form luminaire can be changed by exerting a force on one or more attachment points on the luminaire. A drive system, suitably a pulley drive system, operatively bends the sheet form luminaire in response to user-inputs. For example, actuation of the drive system can twist the sheet form causing a change from one twisted shape to another twisted shape or between an untwisted state to a twisted state. The twisting of the sheet form of the luminaire will not only change the appearance of the physical appearance of the luminaire, it can also advantageously be employed to change the light distribution within a space produced by the luminaire. Alternatively, the drive system could rotate the sheet or roll up the sheet, again changing its appearance within the space. Rotating the sheet without twisting would change the attitude of the luminaire within the space, but not its shape. Rolling the sheet would affect its shape.

A flexible sheet form luminaire has a light emitting side that lies in a plane that will be a flat, curved or twisted plane depending how the luminaire is suspended and how the drive system acts on the luminaire. Changes in the shape and/or attitude of the luminaire will change how its light emitting side faces the illuminated space and thus the direction of the light emission.

In a further aspect of the invention the sheet form luminaire is comprised of a plurality of electrically interconnected planar light sources, such as OLED panels, arranged in rows. The rows of planar light sources are separated by interstitial straightener bars in the plane of the panels, which maintain the sheet form shape of the luminaire and allow the sheet form shape to be twisted or rolled.

DESCRIPTION OF THE ILLUSTRATED EMBODIMENT

Figure 1:
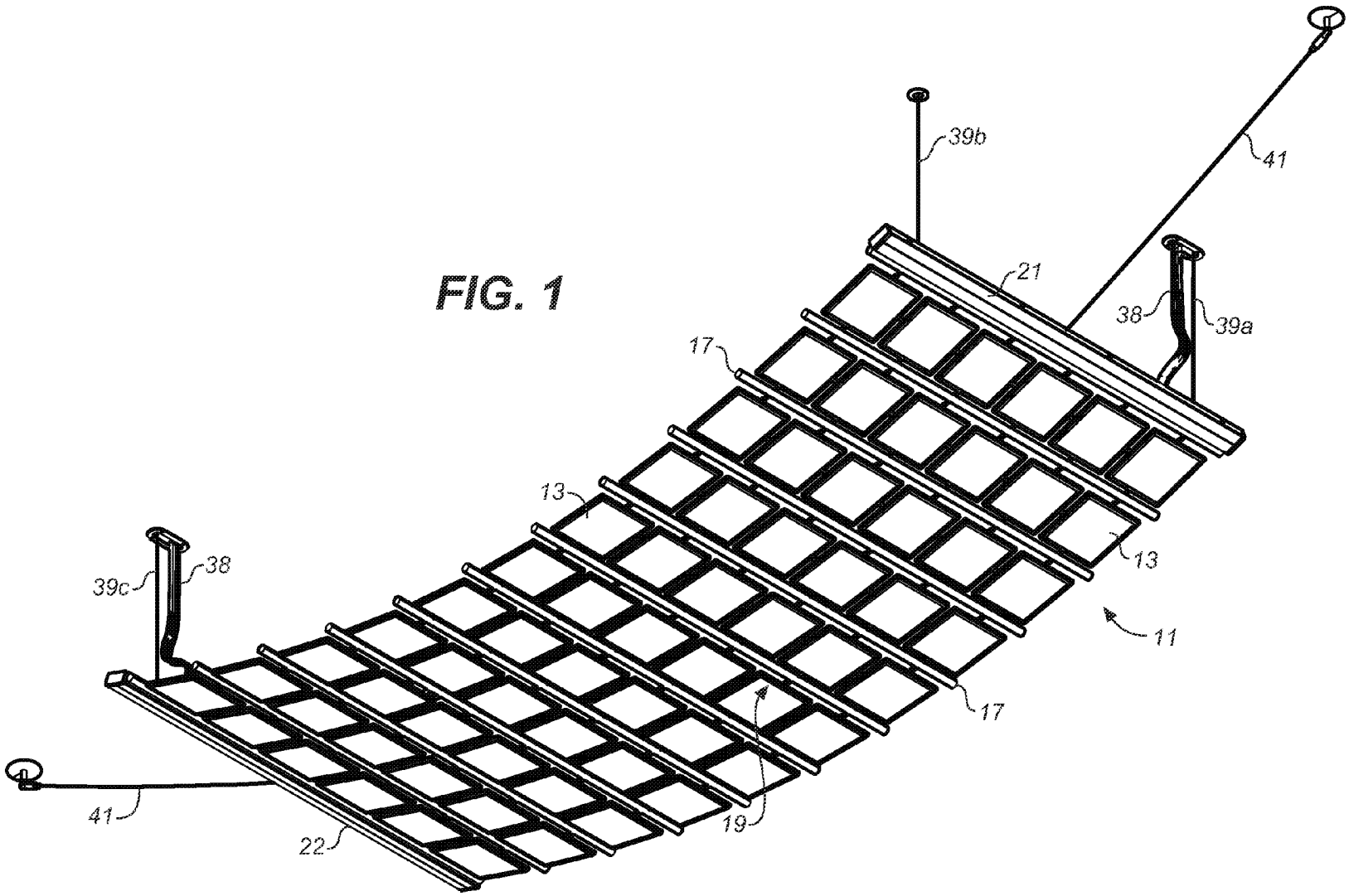
FIG. 1 is a bottom perspective view of a sheet form luminaire capable of changing shape by exerting a force at the corners of the luminaire that causes the luminaire to torque about a longitudinal axis.
Figure 2:
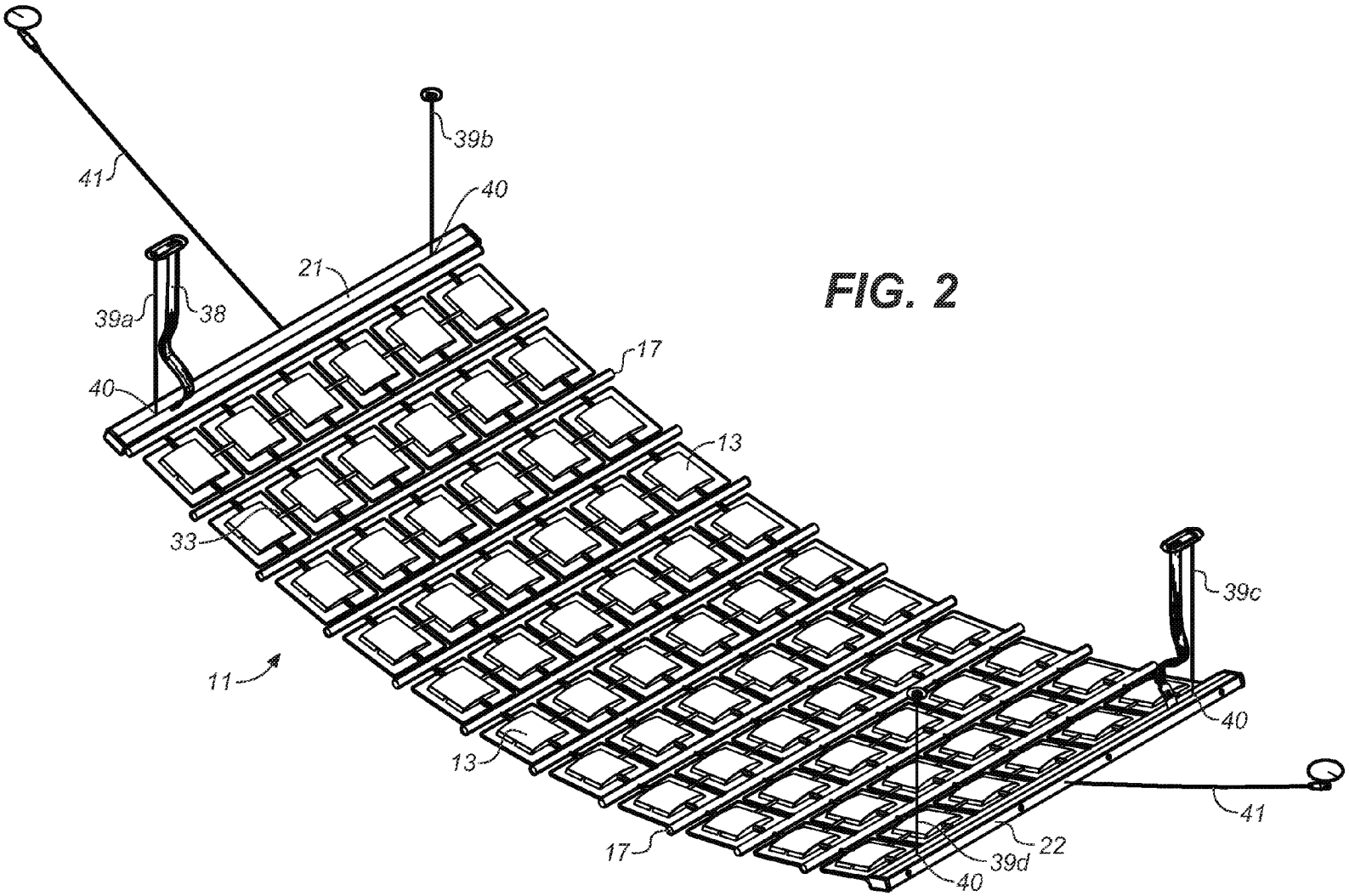
FIG. 2 is a top perspective view thereof.
Figure 3:
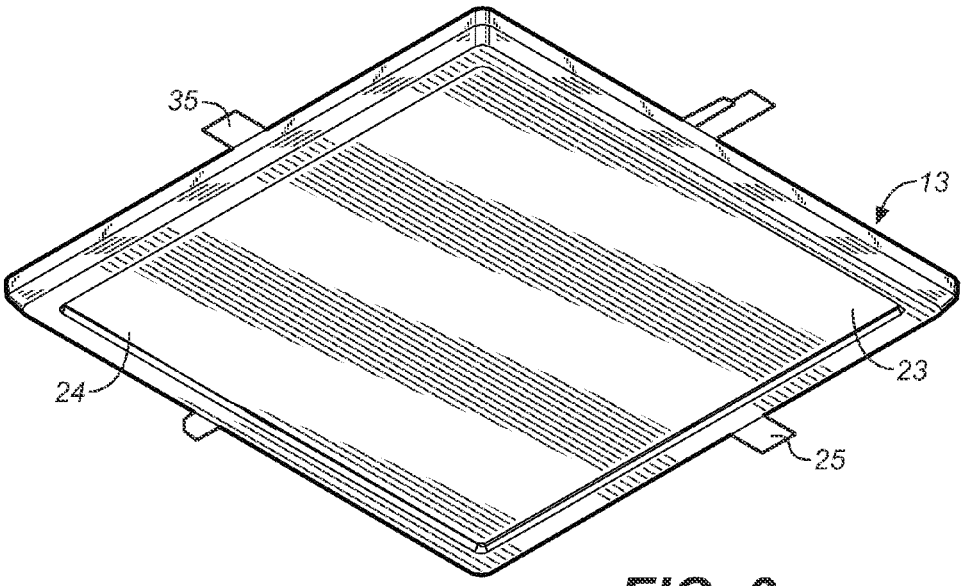
FIG. 3 is a front perspective view of an OLED cassette used to create the sheet form luminaire shown in FIGS. 1 and 2.

Referring now to the drawings, FIGS. 1-2 show a sheet form luminaire, denoted by the numeral 11, comprised of a plurality of planar light sources 13, which can be OLED cassettes as hereinafter described. The planar light sources are arranged in rows, denoted by the numeral 15, which are separated by interstitial straightener bars 17 that maintain the sheet form shape of luminaire. Preferably, the straightener bars are clear acrylic plastic bars having a circular cross-sectional shape; however, the straightener bars could be fabricated of other materials, including opaque materials, and could be provided in different shapes, such as a square shape. The straightener bars will most suitably have a cross-sectional dimension comparable to the front-to-back thickness of the planar light sources. The straightener bars and planar light sources are tied together as hereafter described to form a flexible panel grid assembly 19, which has the form of a flexible sheet of planar light sources.

It is seen that the opposite ends of flexible panel grid 20 are connected to transverse and preferably rigid end rails 21, 22. The end rails can be used to hang the luminaire, and are suitably hollow to provide an enclosed housing for wire management and cable grippers (not shown).

Figure 6:
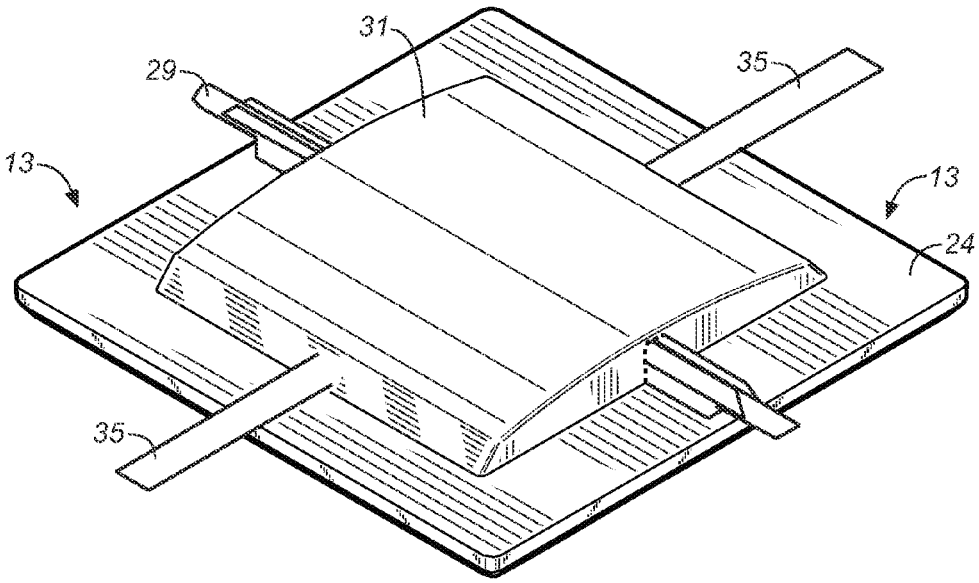
FIG. 6 is a further rear perspective view thereof showing the back of the OLED cassette after the back cover is attached.
Figure 4:
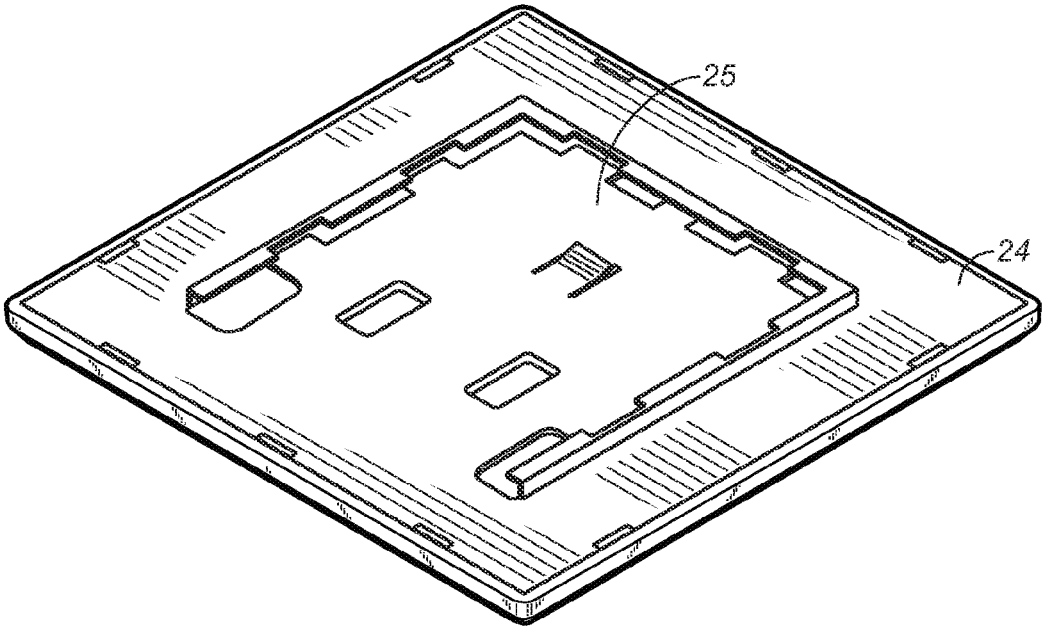
FIG. 4 is a rear perspective view thereof.
Figure 5:
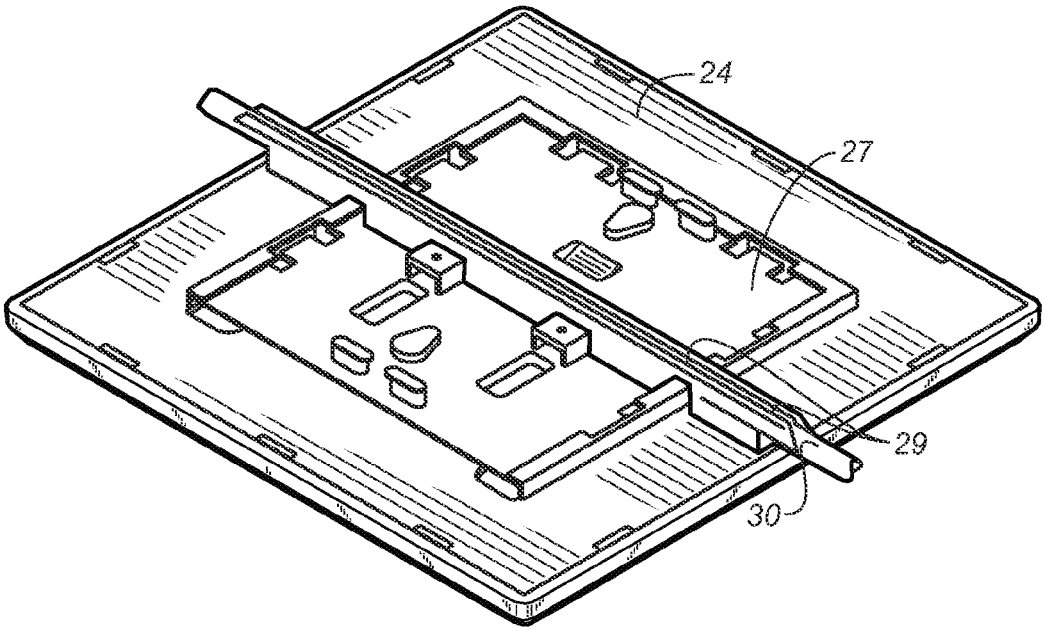
FIG. 5 is another rear perspective view thereof showing the OLED cassette affixed to an adaptor used to secure and wire the OLED cassette.
Figure 7:
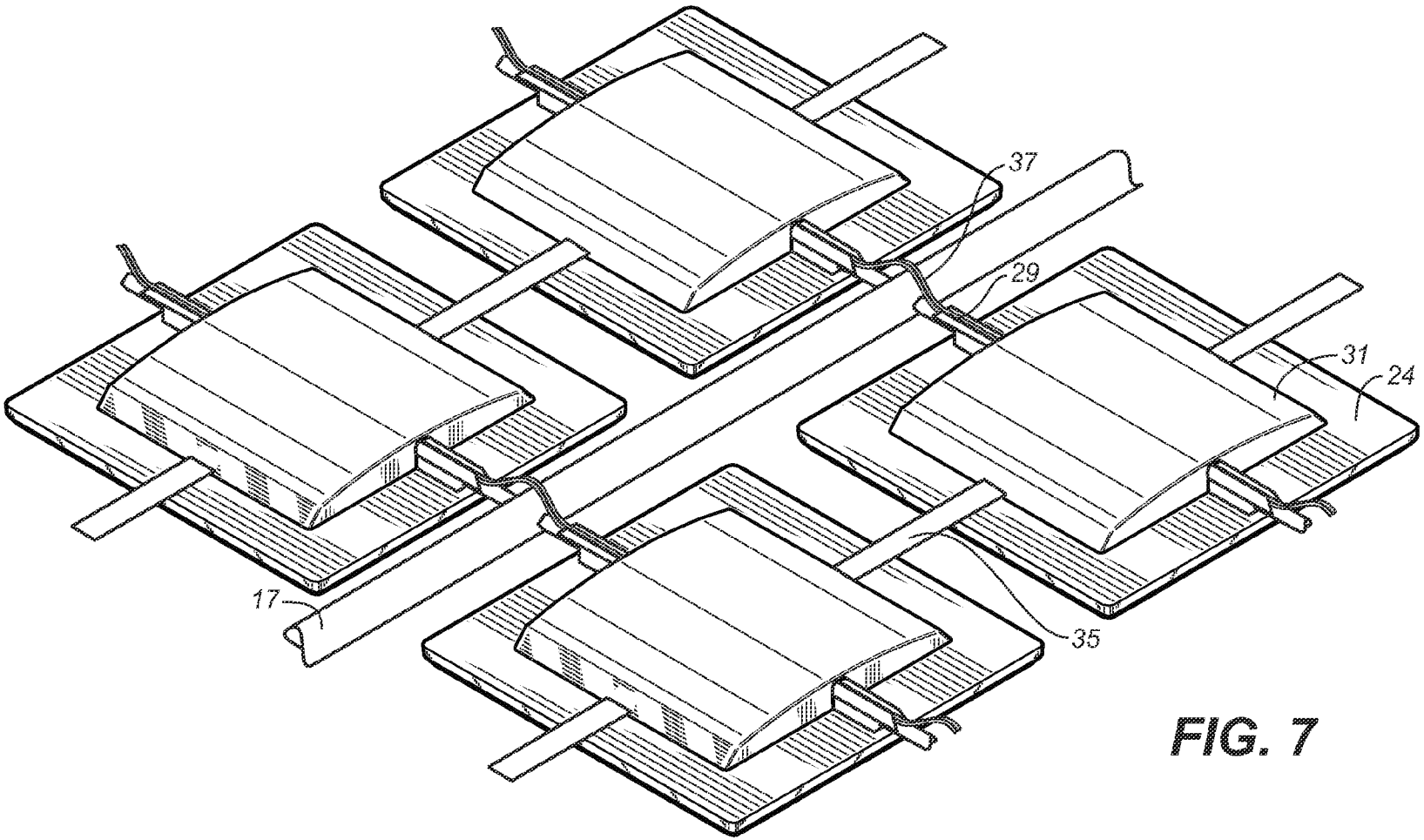
FIG. 7 is a rear perspective view of a group of OLED cassettes with adaptors assembled together with interstitial straightener bars.

FIGS. 3-7 show in more detail a suitable form of a planar light source that can be used to create the flexible panel grid assembly 19 of the sheet form luminaire, and how the panel grid is assembled and wired. FIGS. 3-7 show a low profile OLED cassette 14 containing an OLED panel having a flat light emitting surface 23 (seen in FIG. 3). The back of the OLED cassette has a slide pocket 25 for receiving an adaptor plate 27, which can contain spring contacts for the making an electrical connection to surface electrodes (not shown) on the back of the OLED panel held by the cassette. An elongated cable channel 29 can be snapped onto the back of the adaptor plate by suitable snap in slots provided in the edges of the cassettes slide pocket. As hereinafter described, this cable channel is used to hold the OLED cassette to a flexible cable of the panel grid assembly. As seen in FIG. 6, the adaptor comprised of the adaptor plate and affixed cable channel, can be covered by a decorative back cover 31. (The OLED loaded cassette, adaptor and cable channel will be referred to herein collectively as simply the OLED cassette and denoted by the numeral 13.)

To assemble the panel grid assembly 19, each column of OLED cassettes is strung between end rails 21 by a longitudinal flexible tie cable 33, such as a steel aircraft cable. The straightener bars 17 are also supported on the tie cables, suitable by threading the tie cables through pre-drilled holes in the straightener bars.

To assemble panel grid 19, one end of the tie cables 33 is attached to one of the end rails 21, such as by cable grippers. The first row of OLED cassettes 13 (with back covers removed) can then be threaded onto the free ends of the tie cables and slide up against the end rail. Thereafter, the first straightener rod can be threaded on the tie cables and slide up against the first row of OLED cassettes. The process can be repeated until all the of the OLED cassette panels and straightener rods have been threaded onto the tie cables, after which the free ends of the tie cables can be attached to the other end rail. Elastic straps 35 can then be stretched across the backs of the OLED cassettes in each row of OLED cassettes to keep the OLED cassettes in each row straight and from spinning on the flexible cables 23. The elastic straps, which are suitably fabricated of a clear silicone rubber, can be provided with fastener openings to hook onto hooks on the back of the OLED cassettes. It is seen that the OLED cassettes will be held onto the tie cables in centered relation between the straightening bars by the extended ends 30 of cable channels 29 located on the back of the cassette adaptor plates 27. These extended ends will act as spacers to keep the OLED cassettes from sliding up against one of the straightening rods.

Once the panel grid has been assembled, the OLED cassettes can be wired. Each column of cassette can be wired in series from the end rail to which a power cord is dropped. The thin unobtrusive wires can be threaded along the top of the cable channels and over the back of the straightening rods.

Figure 8:
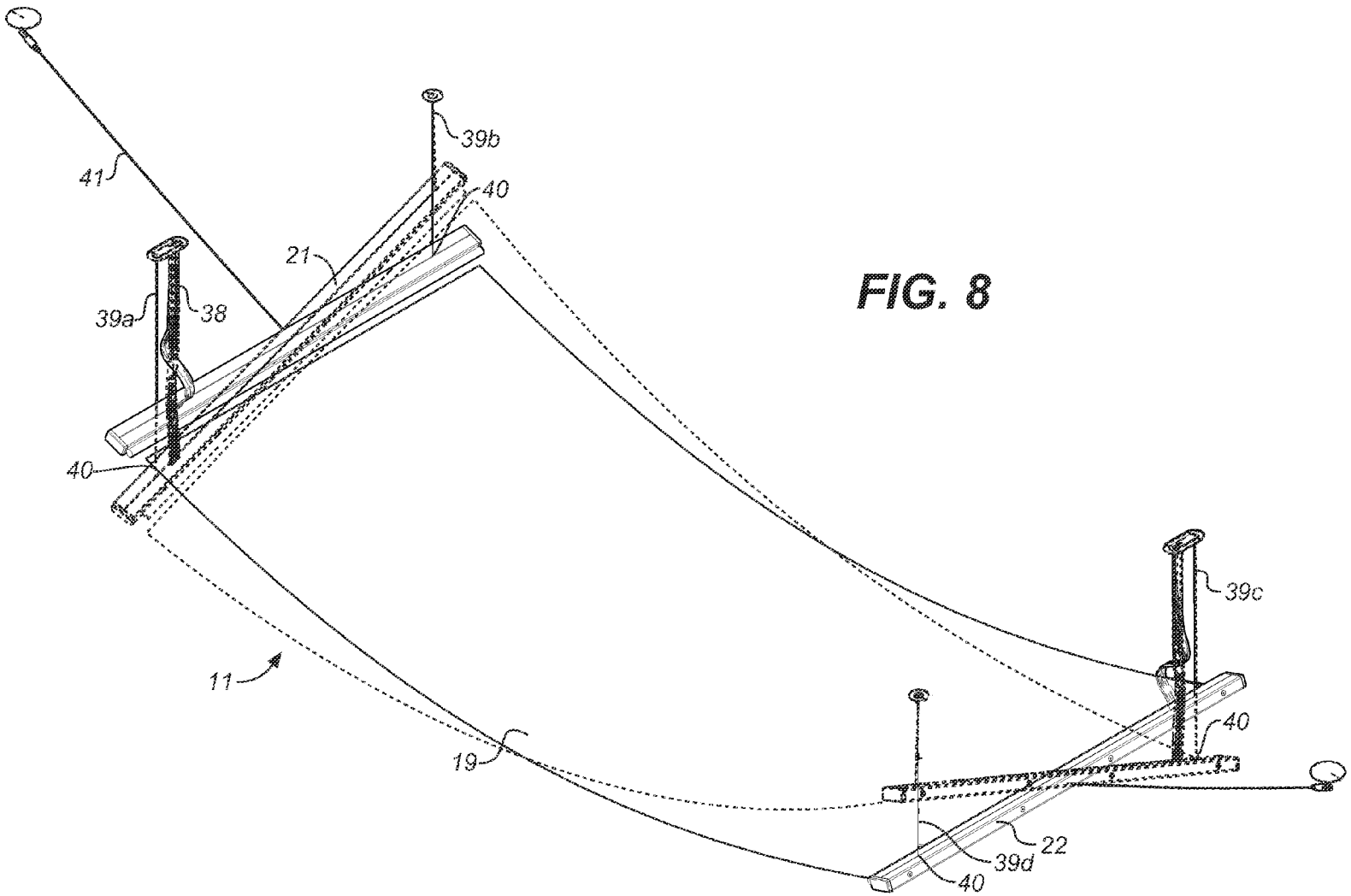
FIG. 8 is a graphical view of the flexible sheet form luminaire showing in FIGS. 1 and 2, showing the torqueing of the luminaire and the resulting change in shape of the luminaire.

FIGS. 8-13 illustrate a pulley drive system for changing the shape of the sheet form luminaire shown in FIGS. 1 and 2 by twisting and the gestural control aspect of the invention. FIG. 8 provides a graphic illustration of the sheet form luminaire 11 suspended from a ceiling by corner pulley cables 39*a*, 39*b*, 39*c*, 39*d* depending from the overhead ceiling to attachment points 40 at the corners of the luminaire's end rails 21, 22. The luminaire is seen to be additionally suspended by fixed suspension cables 41 attached to the center of the end rails. The fixed suspension cables support the weight of the luminaire, while the pulley cables, when actuated, twist the luminaire in response to user input. Power cords 38 can be dropped from the ceiling at each end of the luminaire to feed power to the OLED panel wire housed in the end rails. Preferably, the power cables are dropped next to one of the pulley cables at each end of the luminaire, such as pulley cable 39*a* and 39*c* shown in FIG. 8. The power cords suitably have extra length to allow the pulley cables to be payed out by the pulley drive system for twisting the luminaire.

Figure 10:
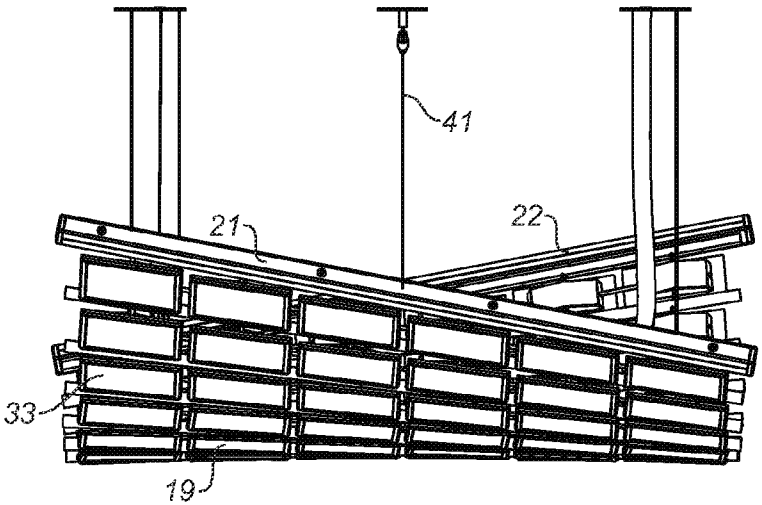
FIG. 10 is another end elevational view thereof showing the change of shape in the luminaire after torque is applied, as in FIG. 8.
Figure 9:
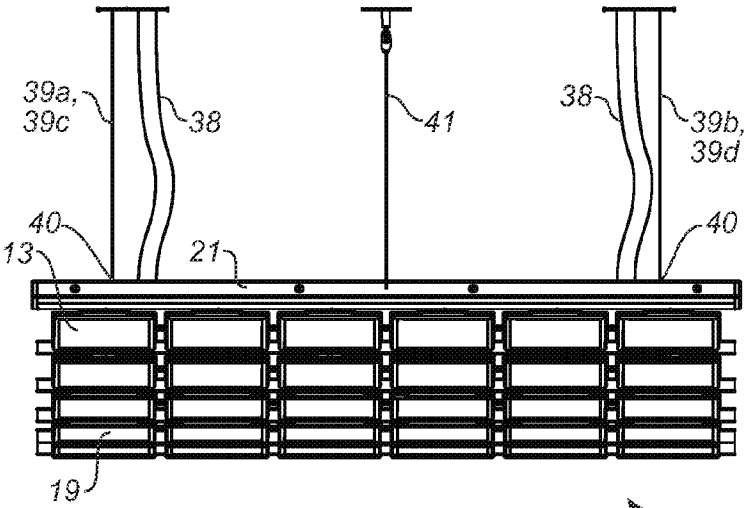
FIG. 9 is an end elevational view of the luminaire shown in FIGS. 1 and 2 before torque is applied.

As illustrated in FIGS. 8-10, the pulley cables of the pulley drive system are attached to the corners of the end rails of the luminaire. To twist the luminaire, diagonally opposed pulley cables such as pulley cables 39*a* and 39*c* are rolled up thereby exerting upward counter forces on these ends. At the same time, pulley cables 39*b*, 39*d* attached to the other two diagonal opposed corners of the of the end rails are payed out by the pulley drive system. The result is the twisting of the panel grid 19 about its longitudinal axis, changing the shape of the luminaire from an untwisted shape shown in FIG. 9 to the twisted shape shown in FIG. 10. A reverse of the pulley drive system will cause the luminaire to twist in the opposite direction.

Figure 11:
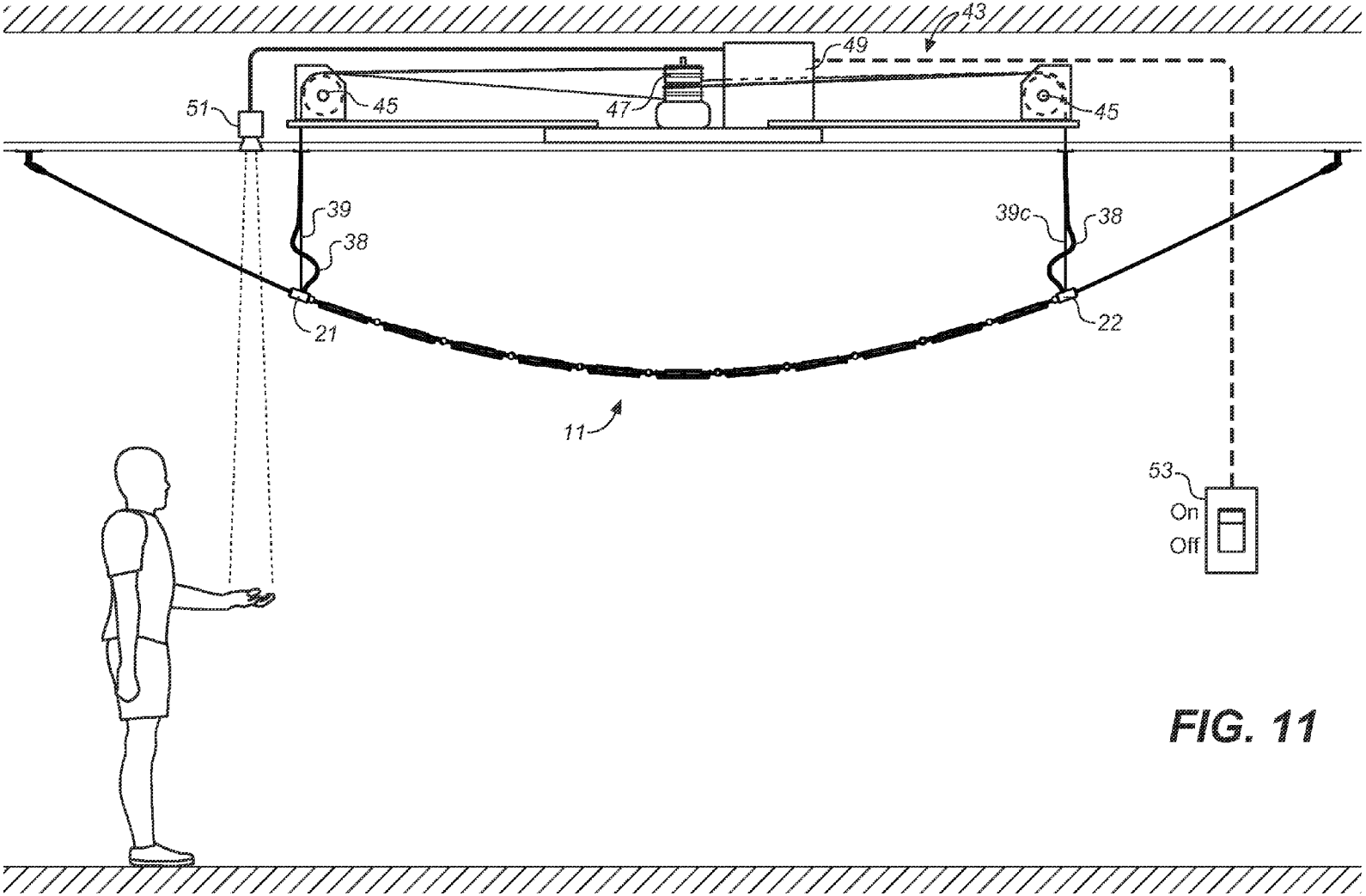
FIG. 11 is a graphical illustration of the luminaire shown in the foregoing drawings suspended below a ceiling and depicting the pulley drive system for changing the shape of the luminaire and additionally showing the initiation of a hand movement for activation of the pulley drive system by gestural control.
Figure 12:
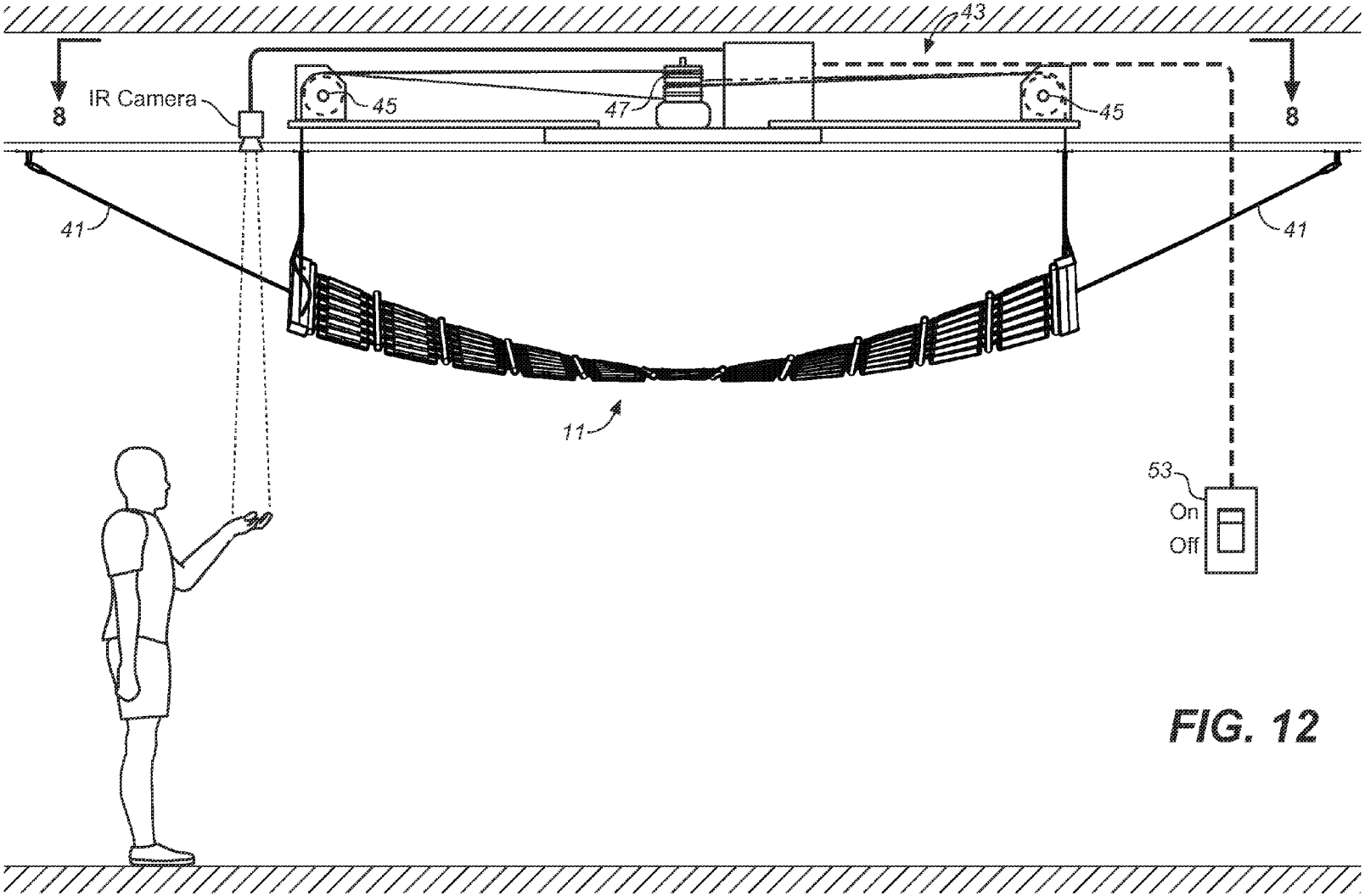
FIG. 12 is another graphical illustration of the ceiling suspended luminaire shown in FIG. 10 showing the movement of the hand and resulting change of shape of the luminaire.
Figure 13:
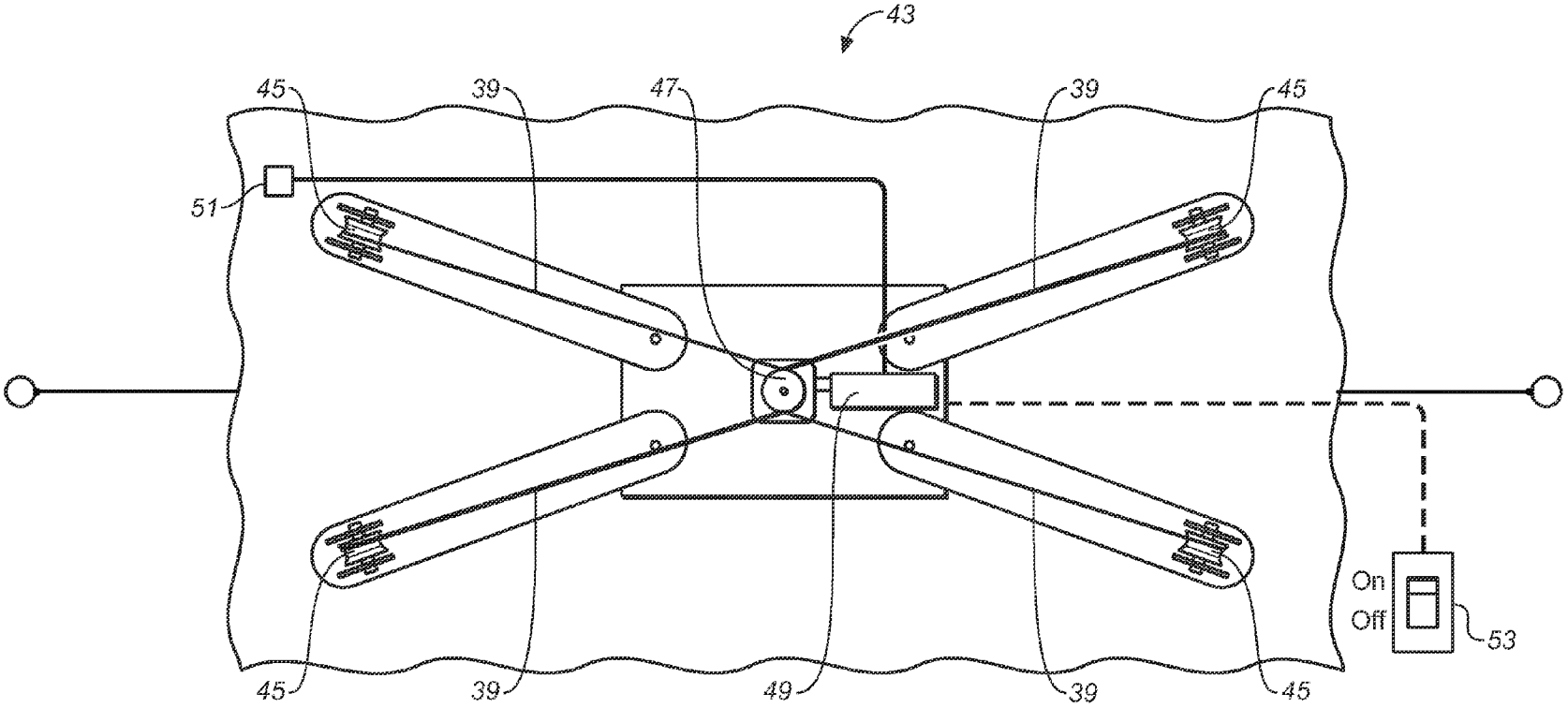
FIG. 13 is a fragmentary top plan view of part of the pulley drive system shown in FIGS. 11 and 12.

As shown in FIGS. 11-13, the pulley drive system 43 can be located above a false ceiling and can include passive corner pulleys 45 over which the pulley cables above the false ceiling are passed, and a center drive pulley 47 that can be actuated by drive motor 49, which is responsive to gestural movements detected by motion sensor 51. An example of the gestural control of the pulley driven system and hence the shape of the sheet form luminaire 11 suspended below the false ceiling is indicated by the standing person shown in FIGS. 11 and 12, who moves his hand up and down within the relatively narrow detection field (denoted be dashed lines in FIG. 11) of the overhead motion sensor 51. The sensor could, for example, be an infrared laser that operates in conjunction with a selective detection system that only responds to a purposeful upward and downward hand movement, and ignores side-by-side movement of the hand or any other human activity that occurs within the detection field. When the detection system detects an upward movement of the hand in the detection field it signals the drive motor 49 to drive the pulley system in one direction for twisting the sheet form luminaire in one direction, and when it detects a downward movement of the hand it signals the motor to drive the pulley system in the reverse direction for twisting the sheet form luminaire in the opposite direction. The system can be deactivated by a suitably located switch, such as the manual on-off switch 53.

Gestural control of the pulley drive system 43 could also be provided by a gestural control switch implementations, such as by the gestural control switch disclosed in commonly owned U.S. Non-Provisional Application Ser. No. 13/888,184, filed May 6, 2013, which is incorporated herein by reference. The gestural control switch disclosed in such applications could be mounted to a wall or other structure in the vicinity of the suspended flexible panel grid assembly 19.

The present invention offers a novel sheet form luminaire that can be formed into different shapes and a method for interacting with such a luminaire via hand gestures, not only to control illumination (dimming, color, etc), but also to control the shape of the luminaire and the directionality of light. While the present invention has been described in some detail in the foregoing specification and the accompanying drawings, it is not intended that the invention be limited to such details unless otherwise indicated herein.

What we claim is:

1. A lighting system comprising:

a luminaire having physical and light distribution characteristics, said luminaire being deformable such that the physical characteristics of the luminaire can be changed, and means for exerting a force on the luminaire in response to a remote user input, wherein a user can change the characteristics of the luminaire in a space without physically touching the luminaire and wherein said means for exerting a force on the luminaire in response to a remote user input is adapted to change the physical characteristics of the luminaire.

2. The lighting system of claim 1 wherein the means for exerting a force on the luminaire in response to a remote user input is adapted to change the light distribution characteristics of the luminaire.

3. The lighting system of claim 1 wherein the luminaire is deformable such that the physical characteristics of the luminaire can be changed and wherein the means for exerting a force on the luminaire in response to a remote user input is adapted to change both the shape of the luminaire and the light distribution characteristics of the luminaire.

4. The lighting system of claim 1 wherein:

the luminaire has a flexible sheet form such that the physical characteristics of the luminaire are defined by the flex condition of the luminaire, said sheet form luminaire having at least one attachment point, and the means for exerting a force on the luminaire in response to a remote user input includes means for exerting a force on the at least one attachment point on the luminaire so as to cause the sheet form of the luminaire to flex and to thereby change its physical characteristics in response to a user input.

5. The lighting system of claim 4 wherein said luminaire has a plurality of attachment points and the means for exerting a force on the luminaire in response to a remote user input includes means for exerting a force on one or more attachment points on the luminaire so as to cause the sheet form of the luminaire to flex and to thereby change its physical characteristics in response to a user input.

6. The lighting system of claim 5 wherein said means for exerting a force on the luminaire in response to a remote user input is comprised of a pulley drive system connected to said attachment points, wherein activation of the pulley system in response to a user input causes the sheet form luminaire to twist between twisted and untwisted states.

7. The lighting system of claim 5 wherein said means for exerting a force on the luminaire in response to a remote user input is comprised of a pulley drive system connected to said attachment points, wherein activation of the pulley system in response to a user input causes the sheet form luminaire to roll between rolled and unrolled states.

8. The lighting system of claim 1 wherein the luminaire is comprised of a plurality of electrically interconnected planar light sources arranged in rows to form a flexible sheet of planar light sources that can be twisted or rolled, and wherein the means for exerting a force on the luminaire in response to a remote user input is adapted to twist said flexible sheet of planar light sources so as to change the physical and light distribution characteristics of the luminaire.

9. The lighting system of claim 1 wherein the luminaire is comprised of a plurality of electrically interconnected planar light sources arranged in rows to form a flexible sheet of planar light sources that can be twisted or rolled, and wherein the means for exerting a force on the luminaire in response to a remote user input is adapted to roll said flexible sheet of planar light sources so as to change the physical and light distribution characteristics of the luminaire.

10. A lighting system comprising:

a luminaire having physical and light distribution characteristics, and means for exerting a force on the luminaire in response to a remote user input, wherein a user can change the characteristics of the luminaire in a space without physically touching the luminaire, and wherein the luminaire is comprised of a plurality of electrically interconnected planar light sources arranged in rows to form a flexible sheet of planar light sources that can be twisted or rolled, and wherein the means for exerting a force on the luminaire in response to a remote user input, is adapted to rotate said flexible sheet of planar light sources so as to change the light distribution characteristics of the luminaire.

11. The lighting system of claim 1 wherein the luminaire is comprised of a plurality of electrically interconnected planar light sources arranged in rows to form a flexible sheet of planar light sources that can be twisted or rolled, and wherein the means for exerting a force on the luminaire in response to a remote user input is adapted to selectively twist, roll and rotate said flexible sheet of planar light sources so as to change the physical and light distribution characteristics of the luminaire or only the light distribution characteristics of the luminaire.

12. The lighting system of claim 1 wherein the means for exerting a force on the luminaire in response to a remote user input includes a motion sensor having a detection field, wherein hand movements within the detection zone of the motion sensor cause forces to be exerted on the luminaire.

13. The lighting system of claim 12 wherein the forces exerted on the luminaire in response to said hand movements are related to the direction of the hand movements within the detection field of said motion sensor, thereby causing a change in the characteristics of the luminaire in a space related to the direction of the hand movement.

14. A ceiling suspended lighting system comprising:

a flexible sheet form luminaire having a light emitting side that lies in a plane and that emits light into a space, said flexible sheet form luminaire having attachment points and being capable of being twisted, means associated with the attachment points of the flexible sheet form luminaire for twisting the sheet form luminaire in response to a remote user input, wherein by remotely activating said means a user can change the physical appearance and light distribution characteristics of the luminaire in a space without physically touching the luminaire.

15. The lighting system of claim 14 wherein said flexible sheet form luminaire is capable of being rolled and wherein means associated with the attachment points of the flexible sheet form luminaire for twisting the sheet form luminaire are also adapted to roll the luminaire.

16. The lighting system of claim 14 wherein said flexible sheet form luminaire is capable of being rotated and wherein means associated with the attachment points of the flexible sheet form luminaire for twisting the sheet form luminaire are also adapted to rotate the luminaire.

17. The lighting system of claim 14 herein said flexible sheet form luminaire is comprised of interconnected light sources arranged in rows of light sources having a thickness.

18. The lighting system of claim 17 wherein said rows of light sources are interconnected through interstitial straightener bars that maintain the sheet form shape of luminaire, but allow the rows of light sources to twist and roll.

19. The lighting system of claim 18 wherein said straightener bars have a cross-sectional dimension comparable to the thickness of the rows of light sources.

20. The lighting system of claim 17 wherein said flexible sheet form luminaire includes rigid end rails, wherein the rows of light sources of said luminaire terminate at said end rails, and wherein said attachment points are provided at the corners of said end rails.

21. The lighting system of claim 20 wherein rows of light sources of said luminaire are electrically connected to an external power source through said end rails.

22. The lighting system of claim 17 wherein said light sources are planar light sources wherein each of the planar light sources is oriented in the plane of the flexible sheet form luminaire.

23. A ceiling suspended lighting system comprising:

interconnected light sources arranged in flexible rows of light sources having a thickness, rigid end rails, each of said flexible rows of light sources being connected to and terminating at said end rails to form a flexible sheet form luminaire that lies in a plane, and each of said end rails having corner attachment points, a pulley drive system connected to the corner attachment points of said end rails, wherein activation of the pulley system in response to a user input causes the sheet form luminaire to twist between twisted and untwisted states.

24. The lighting system of claim 23 wherein said light sources are planar light sources oriented in the plane of the flexible sheet form luminaire.

* * * * *